United States Patent [19]

Heine et al.

[11] Patent Number: 4,867,099

[45] Date of Patent: Sep. 19, 1989

[54] METHOD OF ELECTROSTATICALLY SPRAY COATING EDGE-SUPPORTED SUBSTRATES

[75] Inventors: Werner Heine, Winnenden; Thomas Müller, Steinheim, both of Fed. Rep. of Germany

[73] Assignee: Kopperschmidt-Mueller GmbH & Co. KG., Bielefeld, Fed. Rep. of Germany

[21] Appl. No.: 210,026

[22] Filed: Jun. 21, 1988

[30] Foreign Application Priority Data

Jun. 29, 1987 [DE] Fed. Rep. of Germany ..... 3721404

[51] Int. Cl.[4] ..... B05B 5/02

[52] U.S. Cl. ..... 118/630; 118/503; 198/803.8; 198/405; 198/626

[58] Field of Search ..... 118/630, 634, 633, 324, 118/632, 326, 631, 503; 198/803.8, 691, 626, 405; 204/297 W

[56] References Cited

U.S. PATENT DOCUMENTS

| | | | |
|---|---|---|---|
| 2,684,656 | 7/1954 | Ransburg | 118/626 |
| 3,120,892 | 2/1964 | Henning et al. | 198/803.8 |
| 3,168,885 | 2/1965 | Weiss | 118/421 X |
| 3,286,817 | 11/1966 | Brigham | 198/626 |
| 4,226,324 | 10/1980 | Stocker | 198/405 |
| 4,499,120 | 2/1985 | Marshall, Jr. | 427/178 X |
| 4,643,129 | 2/1987 | Sari | 118/500 X |
| 4,656,051 | 4/1987 | Wojcik | 118/632 X |
| 4,713,257 | 12/1987 | Luttermöller | 427/27 |
| 4,775,046 | 10/1988 | Gramarossa et al. | 198/803.8 |

FOREIGN PATENT DOCUMENTS

| | | | |
|---|---|---|---|
| 2517504 | 7/1976 | Fed. Rep. of Germany . | |
| 3301824 | 1/1983 | Fed. Rep. of Germany . | |
| 3338328 | 10/1983 | Fed. Rep. of Germany . | |
| 3420453 | 6/1984 | Fed. Rep. of Germany . | |
| 0922657 | 4/1963 | United Kingdom | 198/803.8 |

*Primary Examiner*—Shrive Beck
*Assistant Examiner*—Alain Bashore
*Attorney, Agent, or Firm*—Peter K. Kontler

[57] ABSTRACT

Apparatus for electrostatic spray coating of plate-like substrates, particularly printed circuit boards, has one or more endless conveyors or one or more conveyors of finite length with one or two pairs of strip-shaped holding elements for the edges of substrates. The holding elements engage a substantial part or the entire edge of the substrate which is transported through one or more spray coating stations. Each holding element is made of or contains an electrically conductive material, and the holding elements are grounded, at least during travel through the coating station or stations. The holding elements can engage the edges of substrates by friction or they are coated with an adhesive so that they adhere to the edges of the substrates.

37 Claims, 3 Drawing Sheets

A
A
II
T1
T2
Z1
Z2
Z3
Z4
Z5

Fig.5
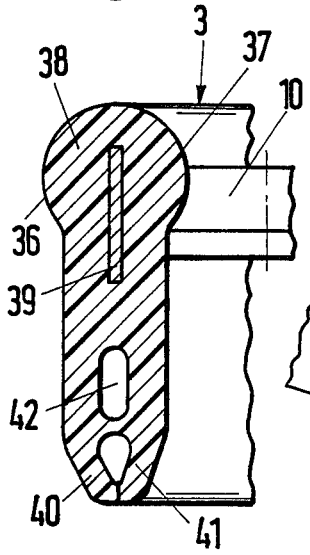
Fig.6
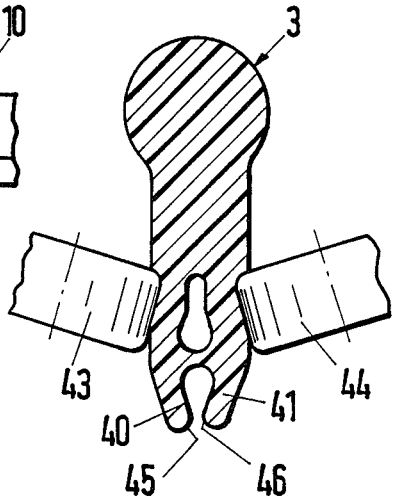
Fig.7
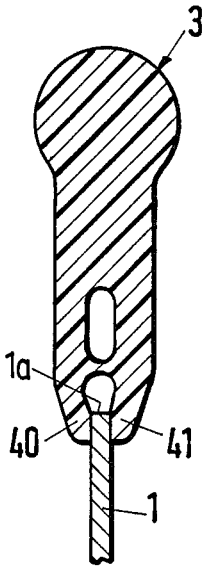
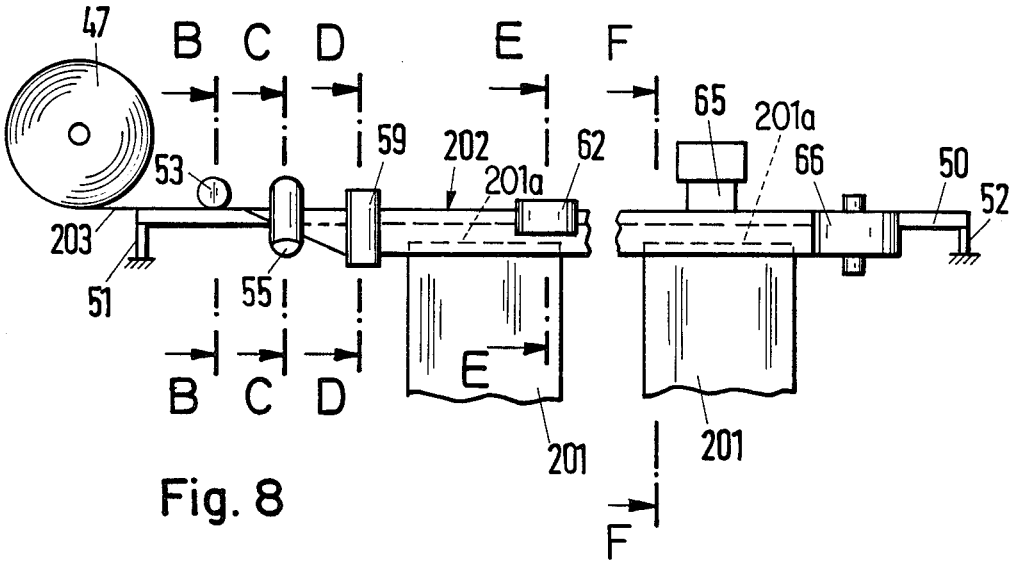
Fig. 8

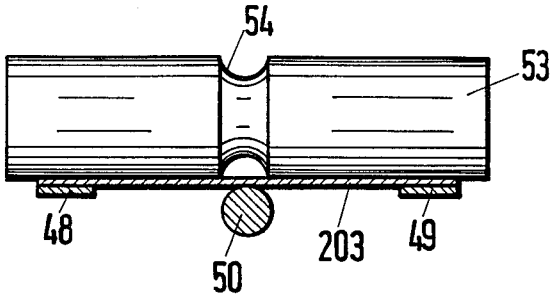
Fig. 9
Fig. 10
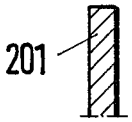
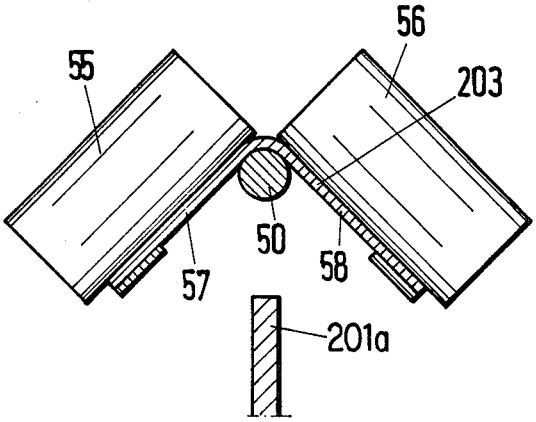
Fig. 12
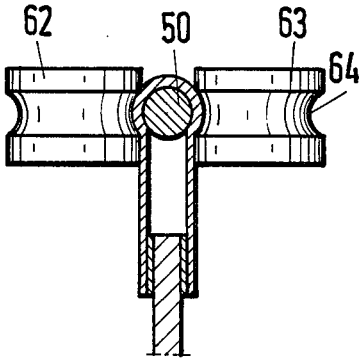
Fig. 11
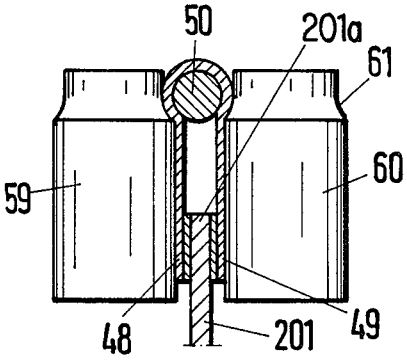
Fig. 13
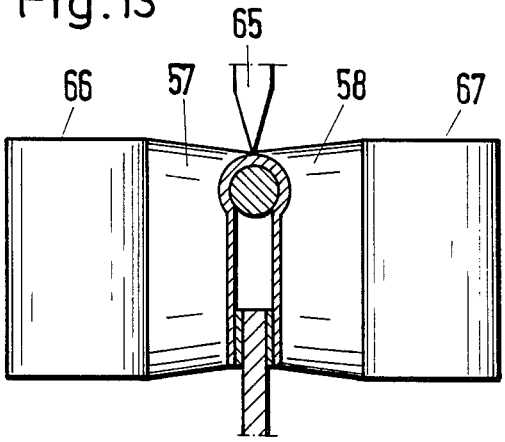

METHOD OF ELECTROSTATICALLY SPRAY COATING EDGE-SUPPORTED SUBSTRATES

BACKGROUND OF THE INVENTION

The invention relates to improvements in apparatus for spray coating substantially plate-like or panel-shaped workpieces, and more particularly to improvements in apparatus for electrostatic spray coating edge-supported substrates which can constitute circuit boards and like components of printed circuits.

It is known to mount plate-like or panel-shaped substrates on a conveyor which is caused to transport the substrates through one or more spray coating zones. As a rule, the conveyor is provided with clamps or like engaging elements which further serve to connect the substrates to the ground. It is important to prevent charging of the substrates by charge carriers which are caused to impinge upon the substrates in the course of an electrostatic spray coating operation, irrespective of whether the material (such as lacquer or paint) which is to form a coat on the substrates is atomized by mechanical or pneumatic means. As a rule, the substrates are grounded by way of the conveyor which transports them through one or more spray coating zones. Reference may be had to German Pat. No. 24 46 767 to Brennecke et al. which discloses an overhead conveyor with hooks on which the substrates are suspended and which transport the substrates through the spray coating zone. The patent further points out that the critical factor in ensuring adequate grounding of conveyed substrates is the manner of attaching the substrates to the conveyor. The reason is that, in the absence of any undertakings to the contrary, the suspending elements of the conveyor become coated with atomized material and their contact or transition resistance increases; this causes undesirable charging of conveyed workpieces. The patentees propose to solve the problem by causing the workpieces to advance past a contact-free discharge unit, at least during movement through the spray coating station.

U.S. Pat. No. 4,643,129 to Sari discloses a system for the treatment of edge-supported substrates, such as printed electronic circuit boards. The patentee does not discuss the problem of adequately grounding the workpieces but is concerned exclusively with the provision of a conveyor which operates without lubrication. The reason is that the patentee proposes to subject substrates to a treatment (such as baking, solvent degreasing, spray coating, drying and the like) which has a deleterious effect upon the lubricant.

German Auslegeschrift No. 25 17 504 of Buschor discloses an electrostatic spray coating apparatus for bottles and like hollow workpieces. The inventor proposes to introduce the grounded electrode into the interior of the hollow workpiece close to the bottom wall and to seal the neck of the workpiece so as to prevent penetration of atomized coating material into the interior of the workpiece.

A similar proposal, is disclosed in German Offenlegungsschrift No. ×01 824 of O'Connel who describes a conveyor which advances parts of automotive vehicles through an electrostatic spray coating station. The supports for the workpieces extend in part into the workpieces and have embedded therein conductor plates or contain conductive pulverulent material so as to establish electrical connections with frames at the undersides of the supports. The frames are grounded through the medium of carriers which extend downwardly and are connected to a chain conveyor or the like.

U.S. Pat. No. 2,684,656 to Ransburg proposes to ground the articles to be spray coated through the medium of the conveyor and to tilt the articles during transport through the electrostatic spray coating station.

German Auslegeschrift No. 2 204 982 of Suhrkamp et al. discloses a method of spray coating articles of glass or ceramic material while the articles are still hot and are grounded by way of their conveyor. The manner of preventing the atomized material from interfering with adequate grounding of the articles is not discussed.

German Offenlegungsschrift No. 34 20 453 of Hell discloses an apparatus for applying different coats to opposite sides of window and door frames. The problem of properly grounding the workpieces during treatment is not discussed by the inventor. He proposes to place partitions between a series of workpieces so as to prevent penetration of one coating material from one side to the other side of the conveyor and vice versa.

German Offenlegungsschrift No. 33 38 328 of Maldonado et al. discloses a continuous automatic film developing apparatus wherein the leaders of successive dental x-ray films are deflected by concave surfaces so as to avoid the need for engagement of the edges of successive films in a manner as shown in FIGS. 3 and 4 of this printed publication. The problem of ensuring adequate grounding does not arise in the apparatus of Maldonado et al.

Commonly owned copending United States patent application Ser. No. 095,319 filed Sept. 10, 1987 by Heine et al. discloses an electrostatic spray coating apparatus wherein an endless apertured conveyor advances the workpieces beneath a spray coating station and its upper reach is located above a slowly running web serving to intercept the coating material which penetrates through the openings of the conveyor.

The assignee of the present application is the owner of numerous pending United States patent applications which deal with certain components of electrostatic spray coating apparatus. Thus, the copending patent application Ser. No. 942,164 filed Dec. 16, 1986 by Kuhn et al. discloses a portable electrostatic spray gun, the copending patent application Ser. No. 940,623 filed Dec. 11, 1986 by Kuhn discloses an apparatus for simultaneously pumping a plurality of liquids, the copending application Ser. No. 159,115 filed Feb. 23, 1988 by Kuhn et al. discloses a nozzle assembly for spray guns, and the copending patent application Ser. No. 159,225 filed Feb. 23, 1988 by Schlinkheider et al. discloses a fluid flow machine. A spraying method and a device for applying a film to a workpiece are disclosed in commonly owned U.S. Pat. No. 4,713,257 granted Dec. 15, 1987 to Luttermöller.

OBJECTS AND SUMMARY OF THE INVENTION

An object of the invention is to provide an electrostatic spray coating apparatus wherein the means for advancing workpieces through one or more spray coating stations is constructed and assembled in such a way that the workpieces (such as the aforediscussed substrates) are reliably grounded without resorting to contact-free discharge units.

Another object of the invention is to provide novel and improved means for moving workpieces through one or more spray coating stations.

A further object of the invention is to provide a conveyor for substrates which is constructed and assembled in such a way that repeated transport of work holding elements through one or more electrostatic spray coating stations does not affect their ability to reliably connect the conveyed workpieces to the ground.

An additional object of the invention is to provide a conveyor which can reliably grasp and transport workpieces through one or more spray coating stations even though its work engaging or holding elements contact only very small portions of the conveyed workpieces.

Still another object of the invention is to provide the apparatus with novel and improved means for automatically separating spray coated workpieces from the advancing means and with novel and improved means for maintaining the workpieces in an optimum orientation during transport through one or more spray coating stations.

A further object of the invention is to provide a novel and improved method of manipulating edge-supported substrates preparatory to, during and after transport through one or more electrostatic spray coating stations.

Another object of the invention is to provide the work advancing means of the apparatus with novel and improved disposable or reusable work holding elements.

A further object of the invention is to provide the apparatus with novel and improved means for preventing deposits of sprayed material from affecting the ability of advancing means to connect the conveyed workpieces to the ground.

The invention is embodied in an apparatus for electrostatically spray coating edge-supported substrates, such as circuit boards. The improved apparatus comprises means for advancing substrates including at least one pair of substantially strip-shaped holding elements which serve to engage at least substantial parts of (particularly the entire) edges of a series of successive substrates, and means for moving the holding elements in a predetermined direction along a predetermined path. The holding elements contain a current-conducting material, and the apparatus further comprises coating means adjacent at least one portion of the path and including means for directing at least one spray of coating material against successive substrates of the series. The apparatus also comprises means for grounding at least one of the holding elements, at least during travel along the at least one portion of the path. Each of the holding elements can constitute an uninterrupted (continuous) strip of finite length or an endless strip.

If the holding elements are strips of finite length, the apparatus further comprises means for supplying the holding elements into a second portion of the path ahead of the at least one portion, and means for gathering the holding elements in a third portion of the path downstream of the at least one portion.

If the substrates have pairs of substantially parallel spaced-apart edges, the advancing means can comprise a pair of holding elements for each edge of successive substrates of the aforementioned series. Such advancing means can further comprise means for changing the orientation of pairs of holding elements and of the substrates between such pairs of holding elements in at least one portion of the path, for example, ahead and/or downstream of the spray coating station or stations. The orientation changing means can comprise means for moving successive substrates of the series between a first plane in which the substrates are substantially horizontal and a second plane in which the substrates are substantially vertical. The arrangement may be such that a portion at least of the orientation changing means is located ahead of the coating means and the substrates of the series are located in or close to a vertical plane during exposure to one or more sprays of coating material.

The advancing means can further comprise an endless elastic carrier for each pair of holding elements. The carrier can be integral with the respective holding elements, and the holding elements on the carrier preferably bear against each other in the absence of edges of substrates between them. This prevents contamination of those portions of the holding elements which normally engage the edges of substrates. Such apparatus preferably further comprises means for spreading the holding elements apart preparatory to introduction of edges of substrates between the holding elements. The spreading means can comprise a pair of rollers or other suitable spreading members which define a clearance or gap for the passage of the carrier between them. The carrier can be provided with at least one longitudinally extending cavity, and successive increments of such cavity pass between the spreading members when the holding elements are in motion. The width of the clearance is selected in such a way that successive increments of the carrier are deformed in the region of the cavity during movement through the clearance whereby the holding elements are spread apart and provide room for introduction of the edges of substrates. Such advancing means further comprises pulleys for the carrier. The carrier is trained over the pulleys and can include at least one profiled portion which engages the pulleys. The rigidity and/or the cross-sectional outline of the carrier is preferably selected in such a way that the holding elements which are integral with the carrier can maintain the substrates in a predetermined orientation during travel along the at least one portion of the path. The arrangement may be such that the carrier is located at a first level and the holding elements which are integral therewith are located at a different second level (e.g., below the first level) during movement along the at least one portion of the path. The carrier can include an elastic body and at least one flexible stiffening member (e.g., a strip or rail of metallic material) which is at least partially confined (e.g., fully embedded) in the elastic body.

The advancing means can comprise an elongated foldable web with two marginal portions which constitute or include the holding elements, and means for folding the web substantially midway between the marginal portions so as to move the marginal portions toward each other and into contact with the edges of substrates between such marginal portions. The marginal portions can be provided with coats of adhesive material so that they adhere to the edges of substrates.

The folding means can be located ahead of the at least one portion of the path and can include an elongated folding member (e.g., a bar which extends along the path and has a substantially circular or oval cross-sectional outline) and means for flexing the web around the folding member so that the marginal portions of the web are disposed at opposite sides of the folding member. Such apparatus preferably further comprises means for severing the web between the marginal portions downstream of the spray coating station or stations, and gathering means for separating the marginal portions of the web from the edges of substrates downstream of the severing means. The separating means can comprise driven takeup reels which peel the marginal portions of the severed web off the edges of the substrates. The advancing means can also comprise a source of web and means (such as the aforementioned separating means) for drawing the web from the source (e.g., off a reel on which the web is stored in convoluted form) and along the path. The flexing means can comprise at least one pair of rolls, and the apparatus can further comprise additional rolls or like parts which support the folding member at necessary spaced-apart locations so that the folding member defines the path for the holding elements and the substrates whose edges are contacted by the marginal portions of the web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 5 is an enlarged transverse sectional view of one of two conveyors forming part of advancing means in the apparatus of FIGS. 1–2 or 3–4 at a location where the conveyor is engaged and deflected by a driven pulley;

FIG. 6 is a similar sectional view of the conveyor and further shows two roller-shaped spreading members which are used to move the holding elements of the conveyor apart for the purpose of providing room for one edge of a substrate;

FIG. 7 is a sectional view similar to that of FIG. 6 but showing the holding elements in engagement with the adjacent edge of the substrates;

FIG. 8 is a fragmentary schematic side elevational view of a third apparatus with advancing means having holding elements of finite length;

FIG. 9 is an enlarged sectional view as seen in the direction of arrows from the line B—B of FIG. 8;

FIG. 10 is an enlarged sectional view as seen in the direction of arrows from the line C—C of FIG. 8;

FIG. 11 is an enlarged sectional view as seen in the direction of arrows from the line D—D of FIG. 8;

FIG. 12 is an enlarged sectional view as seen in the direction of arrows from the line E—E of FIG. 8; and FIG. 13 is an enlarged sectional view as seen in the direction of arrows from the line F—F of FIG. 8.

DESCRIPTION OF PREFERRED EMBODIMENTS

Figures 1, 2, 3, 4:
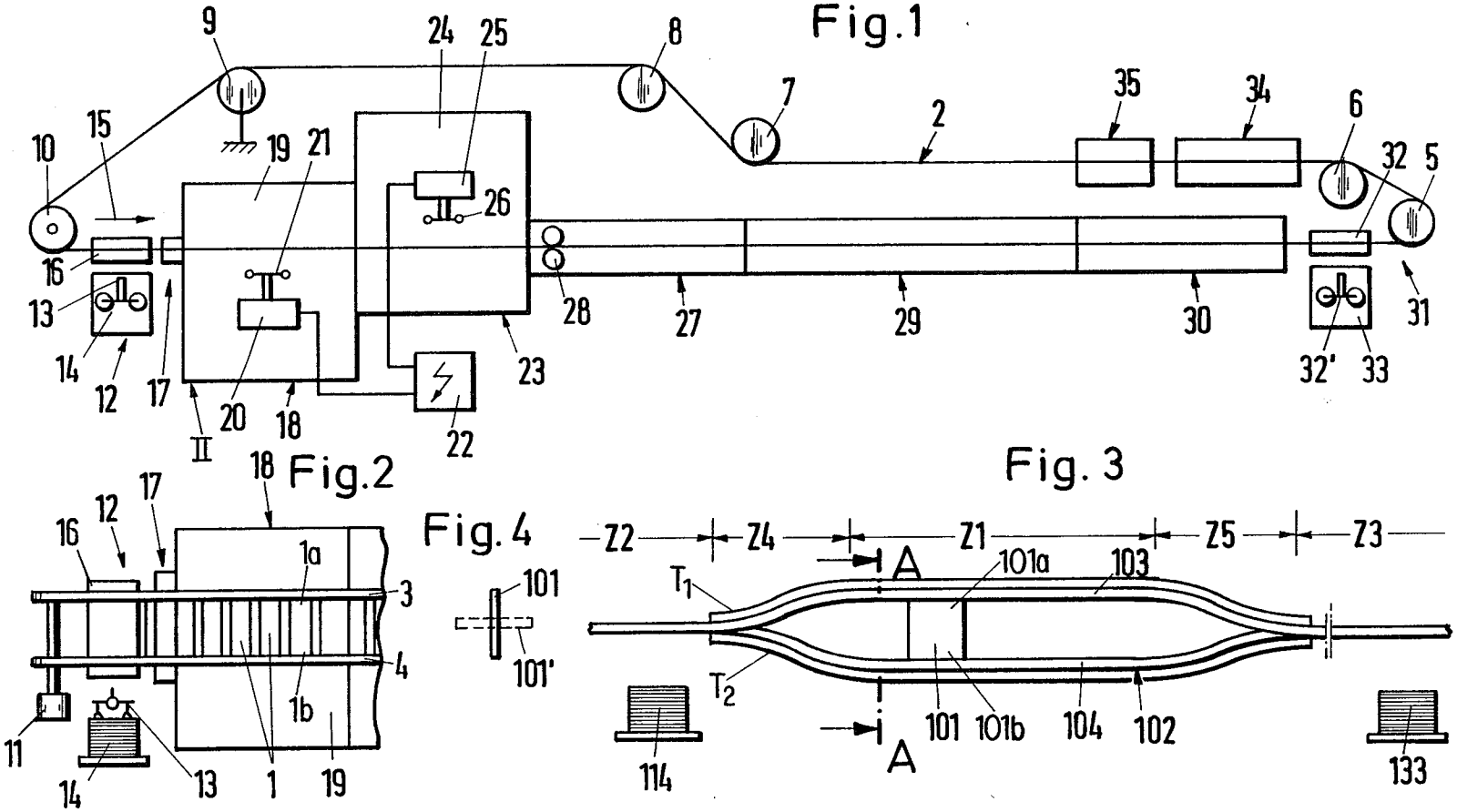
FIG. 1 is a schematic plan view of an apparatus which embodies one form of the invention and wherein two parallel edges of each of a series of plate-like substrates are engaged by pairs of holding elements which advance along an endless path.
FIG. 2 is a fragmentary side elevational view as seen in the direction of arrow II in FIG. 1.
FIG. 3 is a fragmentary elevational view of modified advancing means for the substrates with means for changing the orientation of substrates ahead of and downstream of the spray coating station or stations.
FIG. 4 is a view as seen in the direction of arrows from the line A—A of FIG. 3, with the advancing means omitted.

Referring first to FIGS. 1 and 2, there is shown an apparatus for spray coating plate-like workpieces or substrates 1 which constitute circuit boards for the making of printed circuits. Each of the substrates 1 has two spaced-apart parallel edges 1*a* and 1*b* which are engaged by pairs of elastically deformable strip-shaped holding elements 40, 41 of the type shown in FIGS. 5, 6 and 7. Each side of each of a short or long series of substrates 1 is to be coated with an atomized liquid substance, such as a photosensitive resist. Each substrate 1 can include a main portion of insulating material each side of which carries a thin layer of copper. When the application of coats of photosensitive resist is completed, selected portions of the substrates 1 are exposed and the non-exposed portions are etched away so that the remaining portions of the copper layers constitute conductors. A similar apparatus can be employed thereafter to apply a solder resist.

The apparatus comprises advancing means 2 including two parallel endless conveyors 3 and 4 which respectively comprise pairs of holding elements 40, 41 serving to engage the edges la and lb of the substrates 1 in a manner as can be seen in FIG. 2. FIG. 2 further shows that the entire edge la of each substrate 1 is engaged by the holding elements 40, 41 of the conveyor 3 and the entire edge lb of each substrate 1 is simultaneously engaged by the holding elements 40, 41 of the conveyor 4. The conveyor 3 is disposed at a level above the conveyor 4 so that the properly engaged and held substrates 1 are located in a substantially vertical plane. These conveyors are trained over a plurality of suitably configurated and distributed pulleys 5, 6, 7, 8, 9 and 10 so that they jointly define an endless path preferably having a straight stretch between the pulleys 10 and 5. The direction in which the conveyors 3 and 4 of the advancing means 2 are driven by a suitable prime mover 11 (such as a variable-speed electric motor which is connected with the pulley 10) is indicated by the arrow 15.

The aforementioned elongated stretches of the conveyors 3, 4 between the pulleys 10 and 5 extend along a loading station 12 including a transfer unit 13 which is equipped with one or more suction heads to lift successive substrates 1 off a pile or stack 14 (see particularly FIG. 2) and to deliver the thus lifted substrates into the path of movement of the conveyors 3 and 4. If the conveyors 3 and 4 are driven intermittently, the transfer unit 13 can deliver successive substrates 1 directly from the stack 14 into the spaces between the conveyors 3 and 4. However, if the conveyors 3 and 4 are driven continuously, the apparatus preferably further comprises a unit 16 which accepts successive substrates 1 from the transfer unit 13 and accelerates the substrates prior to inserting them between the conveyors 3 and 4. It will be noted that the transfer unit 13 changes the orientation of successively lifted substrates 1 through an angle of 90 degrees, namely from a horizontal plane on the pallet which supports the stack 14 into a vertical plane including the elongated straight stretches of the conveyors 3 and 4. The accepting unit 16 can include two pairs of roller-shaped members 43, 44 two of which are shown in FIG. 6 and serve to spread the respective holding elements 40, 41 apart so as to provide room for insertion of the edges la of substrates 1 which have been lifted off the stack 14.

The loading station 12 is followed by a preliminary cleaning station 17 in which the properly held substrates 1 of the series of substrates between the conveyors 3 and 4 are cleaned by ionized compressed air.

The cleaning station 17 is followed by a first coating means 18 which comprises a substantially closed housing or tunnel 19 for a coating unit 20 having means 21 for directing at least one spray of coating material against one side of each substrate 1 of the series of substrates between the conveyors 3 and 4. The spray directing means 21 can comprise one or more rotary atomizing devices which mechanically atomize the material to be sprayed onto the respective sides of the substrates 1. Furthermore, the coating unit 20 comprises a high-voltage electrode which ionizes the atomized particles. The high-voltage electrode can constitute the spray directing means 21 and is electrically connected with a source 22 of high voltage. The conveyors 3 and 4 are grounded by way of one or more pulleys 5–10 (see the grounded pulley 9 in FIG. 1).

The coating means 18 is followed by a second coating means 23 which can be a replica of the coating means 18 and comprises a housing or tunnel 24 containing a coating unit 25 having means 26 for directing one or more sprays of atomized coating material against the other side of each of the series of substrates 1 between the conveyors 3 and 4. The spray directing means 26 can again comprise one or more rotary mechanical atomizers, and the coating unit 25 is further connected with the aforementioned source 22 of high voltage. The exact construction of the units 20 and 25 in the at least substantially closed housings or tunnels 19 and 24 of the respective coating means 18 and 23 forms no part of the present invention.

If the atomized material which is sprayed onto the respective sides of the substrates 1 during travel through the housings 19 and 24 is a photosensitive resist, the second coating means 23 is preferably followed by an evaporation promoting station 27 where the resist is permitted to form films of uniform thickness. The station 27 can further contain or is adjacent two supporting rolls 28 which can be idler rolls and serve to ensure that the substrates 1 which advance with the elongated straight stretches of the conveyors 3 and 4 remain in an optimum orientation and at an optimum level during travel through successive stations which follow each other in the direction of arrow 15 as seen from the driven pulley 10 toward the pulley 5. The stiffness of the material of the conveyors 3 and 4 and/or the cross sectional configuration and dimensions of these conveyors are preferably selected in such a way that the conveyors will not sag during travel between the supporting rolls 28 and the pulley 5. This is desirable and advantageous because it entails a reduction of the number of parts which are likely to be contaminated by the material of the coats at the sides of substrates 1 leaving the coating means 23. In other words, if the conveyors 3 and 4 are supported exclusively by a single pair of supporting rolls 28, the operators must ensure that only such single pair of rolls will operate properly in spite of eventual depositions of coating material, or that such rolls will be cleaned or replaced at required intervals.

The evaporation promotion station 27 is followed by a drying station 29 wherein the coats of freshly applied atomized material can be dried by infrared light. If desired or necessary, it is also possible to provide at the station 29 one or more adjustable solvent evacuating or sucking devices of conventional design (not shown in FIG. 1).

The drying station 29 is followed by a cooling station 30 wherein the coats at the sides of successive substrates 1 are contacted by filtered fresh air. This station can also accommodate one or more evacuating means for solvents.

The cooling station 30 is followed by an unloading station 31 wherein a suction-operated transfer unit 32' (which can be a replica of the transfer unit 13 at the loading station 12) is employed to remove successive substrates 1 from the conveyors 3, 4 and to deposit the thus removed substrates onto a suitable pallet or the like so that the removed substrates form a pile or stack 33. The reference character 32 denotes an accepting unit which is a functional and preferably structural equivalent of the unit 16 (see FIG. 6) serving to move the holding elements 40, 41 of the conveyors 3 and 4 apart so as to facilitate removal of treated substrates 1 from the conveyors 3 and 4 by the transfer unit 32'.

The pulley 6 for the conveyors 3, 4 of the advancing means 2 is followed by a cleaning unit 34 wherein the conveyors 3 and 4 are cleaned chemically, mechanically, with ultrasound or in any other suitable conventional way. The cleaning means 34 is or can be followed by a drying station 35 wherein liquid particles or films (if any) adhering to the conveyor 3 and/or 4 are evaporated before successive increments of the conveyors advance toward the pulleys 7, 8, 9 and 10.

FIGS. 5, 6 and 7 show certain details of one of the conveyors 3 and 4, namely of the upper conveyor 3 of the advancing means 2. This conveyor includes an endless elastic carrier 38 which is integral with the respective strip-shaped holding elements 40, 41 and includes profiled portions 36, 37 which are engageable by the pulleys 5–10 during travel of successive increments of the conveyor 3 along the endless path which is shown in FIG. 1. It will be noted that the pulleys 5, 6, 8, 9 and 10 engage one side of each of the conveyors 3, 4 and the pulley 7 engages the other sides of such conveyors. The profiled portions 36, 37 together form a substantially circular bead at the upper end of the carrier 38. This carrier is preferably reinforced by a flexible stiffening member 39 in the form of a flat rail or strip of suitable metallic material which is at least partially but preferably completely embedded in the elastic material of the carrier 38.

The holding elements 40, 41 can constitute the lower part of the conveyor 3 and are integral with the carrier 38. These holding elements respectively have surfaces 45, 46 which normally bear against each other in a manner as shown in FIG. 5 so as to prevent contamination of such surfaces by atomized coating material or by any other foreign matter. The surfaces 45, 46 serve to engage and hold the respective edge 1*a* of the substrate 1 which is inserted between the holding elements 40, 41 at the loading station 12 by the accepting means 16. The elasticity of the material of the conveyor 3 suffices to ensure that the holding elements 40, 41 invariably assume the positions which are shown in FIG. 5 whenever such holding elements are not called upon to engage and hold edges 1*a* of substrates 1.

The holding elements 40, 41 are located at a level below a longitudinally extending cavity 42 which is provided in the carrier 38 beneath the stiffening member 39 and permits ready deformation of the carrier for the purpose of moving the surfaces 45, 46 of the holding elements 40, 41 apart in a manner as shown in FIG. 6. The accepting means 16 comprises two roller-shaped members 43, 44 which define a relatively narrow clearance or gap for successive increments of the carrier 38 in the region above the holding elements 40, 41. As successive increments of the carrier 38 enter the clearance between the roller-shaped members 44, 44, the carrier undergoes deformation which suffices to spread the holding elements 40, 41 apart so as to permit insertion of upper edges la of successive substrates 1 at the loading station 12 of FIG. 1. The holding elements 40, 41 invariably tend to move their surfaces 45, 46 toward each other, namely toward the positions which are shown in FIG. 5, and thus clamp the upper edges 1*a* of successive substrates 1 and hold the substrates in optimum positions and orientation during transport through the preliminary cleaning station 17, through the coating means 18 and 23, as well as through the stations which follow the coating means 23.

The transfer or contact resistance between the properly engaged edges la of the substrates 1 and the current-conducting holding elements 40, 41 is very low because the surfaces 45, 46 which contact the edges 1*a* are invariably free of contaminants since they engage each other (see FIG. 5) or bear against the respective sides of properly inserted substrates 1 (see FIG. 7). Consequently, each properly installed substrate 1 is adequately grounded during transport through the housings or tunnels 19 and 24 of the coating means 18 and 23.

Since the holding elements 40 and 41 engage the entire edges 1*a* of the substrates 1, they need not bear against the edges 1*a* with a substantial force in order to properly support the substrates during transport at 17, 18, 23, 27, 29 and 30. This is desirable and advantageous because it simplifies insertion and removal of substrates.

Another important advantage of the holding elements 40, 41 of the type shown in FIGS. 5–7 is that they can properly support the substrates 1 even though they engage very narrow edges 1*a* of the substrates. This ensures that only very small portions of the two major surfaces of each substrate 1 remain uncoated. In fact, relatively narrow uncoated edges 1*a* and 1*b* are desirable and advantageous in connection with many subsequent treatments of substrates which are unloaded at the station 31. Those portions of the edges 1*a* which are engaged by the surfaces 45, 46 of the holding elements 40, 41 are totally devoid of any coating material; this is desirable and advantageous for subsequent treatment of the substrates. Absence of coating material at both sides of the edges la is desirable and advantageous because this reduces the contact or transfer resistance during subsequent treatment of substrates.

The conveyor 4 is preferably a mirror image of the conveyor 3 of FIGS. 5–7. The conveyor 4 has a pair of holding elements 40, 41 which engage the lower edges 1*b* of successive substrates 1.

The apparatus of FIGS. 1 and 2 can be readily converted for treatment of wider or narrower substrates. All that is necessary is to move the conveyor 3 upwardly and away from the conveyor 4 and/or to move the conveyor 4 downwardly and away from the conveyor 3. Inversely, the conveyors 3 and 4 will be moved nearer to each other if the apparatus is to treat substrates which are narrower than those shown in FIG. 2. The material of the conveyors 3 and 4 is selected in such a way that at least the outer layer or layers can readily withstand the chemical and/or other influences of material which is sprayed onto the substrates 1 during travel through the housings 19 and 24. The conductivity of carriers 38 which constitute component parts of the conveyors 3 and 4 can be achieved by incorporating into the elastic material of such carriers a conductive material. Of course, it is also possible to select the material of the carriers 38 in such a way that the carriers conduct electric current without the incorporation of additives therein. Still further, it is possible to coat portions of or the entire carriers 38 with current-conducting films which come into contact with the pulley 9 to thus ensure adequate grounding of the two pairs of holding elements 40, 41. It has been found that conveyors made of silicon rubber coated with layers of polytetrafluorethylene are especially suitable for use in the apparatus of the present invention. The conductivity of such conveyors can be achieved by incorporating in the silicon rubber and/or in the coats of polytetrafluorethylene particles of carbon or the like.

Referring to FIGS. 3 and 4, there is shown a portion of a modified advancing means 102 including two conveyors 103, 104 corresponding to the conveyors 3 and 4 of FIGS. 1, 2 and 5–7. FIG. 3 further shows a stack 114 of substrates 101 at a loading station corresponding to the loading station 12 of FIG. 1, and a stack 133 of treated or coated substrates 1 at a station corresponding to the unloading station 31 of FIG. 1. The apparatus of FIGS. 3 and 4 further comprises tracks $T_1$ and $T_2$ which constitute a means for changing the orientation of conveyors 103, 104 and substrates 101 between such conveyors starting at the loading station or immediately downstream of the loading station and again downstream of the coating means (not shown in FIG. 3). The purpose of the orientation changing tracks $T_1$ and $T_2$ is to avoid the need for turning successive substrates 101 prior to insertion between the conveyors 103 and 104. In other words, instead of being caused to change their orientation prior to placing between the conveyors 103, 104, the substrates 101 are caused to change their orientation during travel with the conveyors toward, through and beyond the coating means (the apparatus of FIG. 3 can include one, two or more coating means including the coating means 18 and/or 23 of FIG. 1). Thus, while traveling through the coating zone Z1, the substrates 101 are located in a vertical plane which is presently preferred in connection with many types of coating means. On the other hand, the substrates 101 are located in horizontal planes at the loading station Z2 and at the unloading station Z3. The change of orientation takes place in the zone Z4 which precedes the coating zone Z1 and in the zone Z5 which precedes the unloading zone Z3 and can but need not immediately follow the coating zone Z1.

FIG. 4 shows a substrate 101 by solid lines in an orientation it assumes during travel through the zone Z1, and by broken lines (at 101') in an orientation it assumes in the zones Z2 and Z3. It will be noted that the tracks $T_1$ and $T_2$ can change the orientation of successive substrates 101 through 90 degrees, the same as the transfer units 13 and 32' of FIG. 1. The tracks $T_1$ and $T_2$ can impart to the conveyors 103 and 104 the shape of portions of helices during travel in the zones Z4 and Z5. It is clear that the illustrated tracks constitute but one of the numerous means which can be utilized to change the orientation of conveyors 103 and 104 in the zones Z4 and Z5. For example, such tracks can be replaced with sets of suitably distributed and oriented rolls or pulleys which guide the profiled portions (such as 36 and 37) of the carriers 38 forming part of the conveyors 103 and 104. Each of the conveyors 103, 104 can be identical with the conveyor 3 which is shown in FIGS. 5–7.

An advantage of the apparatus which is shown in FIGS. 3 and 4 is that it renders it possible to simplify the instrumentalities at the loading and unloading stations.

Some advantages of the apparatus of the type shown in FIGS. 1–2 and 5–7 as well as of the apparatus of FIGS. 3–4 were pointed out above. Such apparatus exhibit numerous additional advantages. For example, since each of the edges 1*a*, 1*b* or 101*a*, 101*b* is engaged along the full length of the respective substrate 1 or 101, the force with which the holding elements 40, 41 must bear against the respective edges need not be pronounced which reduces the likelihood of damage to the substrates and/or extensive wear upon the carriers 38 of the conveyors 3, 4 and 103, 104. Moreover, and as already pointed out above, the edges 1*a*, 1*b* and 111*a*, 101*b* can be very narrow so that the width of uncoated marginal portions of the substrates 1 and 101 is very small. This is desirable in connection with the treatment of numerous types of substrates. The surfaces 45 and 46 of the holding elements 40, 41 confront each other and are properly concealed and shielded from sprays of atomized material during travel through the coating means of the improved apparatus to even further reduce the likelihood of contamination by sprays of coating material and eventual increase of contact resistance which could affect the efficiency of grounding of the substrates during travel through the coating station or stations. Since the holding elements 40, 41 are in contact with long portions of (or with entire) edges of the substrates 1 or 101, at least one portion of at least one of the edges 1*a*, 1*b* or 101*a*, 101*b* invariably comes into current-conducting contact with the conveyor 3 or 4 of the apparatus of FIG. 1 or with the conveyor 103 or 104 of the apparatus of FIG. 3 so as to ensure adequate grounding, even under most adverse circumstances. Since at least those portions of the edges 1*a*, 1*b* or 101*a*, 101*b* which are engaged by the surfaces 45, 46 of the holding elements 40, 41 during travel through the coating station or stations are devoid of any coating material, the coating material is not likely to contaminate the instrumentalities which engage the uncoated marginal portions or edges of the substrates 1 or 101 during treatment which follows removal of substrates at the unloading station. For example, such instrumentalities could be contaminated if they were to contact coats of material which was admitted at 18 and/or 23 subsequent to a softening of such coats during treatment that follows unloading of the substrates 1 at the station 31 and unloading of substrates 101 at the corresponding unloading station of the apparatus which is shown in FIGS. 3 and 4.

The substrates 1 and 101 can be coated with thin layers of copper at one or both sides of the plate-like supports of insulating material. The holding elements 40, 41 are not likely to damage the thin copper layers along the edges 1*a*, 1*b* or 101*a*, 101*b* during transport toward, through and beyond the coating station or stations where the major parts of the substrates are coated with photosensitive resist. Moreover, the layers of copper which coat the edges of the substrates 1 and 101 ensure the establishment of satisfactory and reliable connections with the ground during transport through the coating station or stations. The aforediscussed contact or transition resistance between the carriers 38 and the edges of the substrates which are held by the conveyors 3, 4 or 103, 104 is extremely low due to the large-area contact between the surfaces 45, 46 and the respective edges. The fact that the very narrow edges of the substrates are not coated with a photosensitive resist is of no consequence in most or all instances because, as a rule, a finished printed circuit does not have any conductors so close to its edges. Moreover, if the following treatment of substrates 1 and 101 involves the application of solder resist in a manner similar to that described in connection with the application of photosensitive resist, the uncoated edges 1*a*, 1*b* or 101*a*, 101*b* are available for proper engagement by the carriers of the apparatus in which the solder resist is being applied subsequent to the application of photosensitive resist. In many heretofore known spray coating apparatus, it was necessary to carve out certain central portions of the substrates in order to provide openings for the application of holding elements in the form of hooks or the like.

While it is possible to provide the conveyors of the advancing means 2 or 102 with spaced-apart pairs of holding elements 40, 41, one for each of the substrates 1 or 101, it is presently preferred to construct the carriers 38 in a manner as described above, namely so that the carriers are provided with continuous holding elements 40, 41 which engage the entire edges of the substrates and also extend across the spaces between neighboring substrates of the series of substrates which are transported through the coating station or stations. This simplifies the construction of the carriers 38 and further reduces the likelihood of penetration of coating material into contact with the surfaces 45 and 46 because the inherent resiliency of the carriers 38 compels the holding elements 40, 41 to invariably assume the positions which are shown in FIG. 5 between neighboring substrates 1 or 101. In other words, the surfaces 45, 46 of the holding elements 40, 41 either engage the edges of substrates or engage each other to thus completely seal the respective ends of the carriers 38 against penetration of coating material between the holding elements.

Another advantage of continuous holding elements is that they can properly engage relatively short or relatively long substrates (as seen in the direction of arrow 15 in FIG. 1).

Since the holding elements 40, 41 are highly unlikely to be contaminated by coating material, the carriers 38 can constitute endless flexible elements which are caused to travel along an endless path so that each increment of each holding element repeatedly engages substrates during travel through the loading station and conveys the thus received and held substrate through the coating station or stations. This reduces the cost of the apparatus because it is not necessary to employ dispensable conveyors for substrates. The apparatus can comprise one or more cleaning units which can remove impurities from the carriers 38 of both conveyors ahead of the loading station.

The apparatus of FIGS. 1–2 or 3–4 could be simplified by omitting one of the conveyors, for example, the conveyor 4 of FIG. 1 and the conveyor 104 of FIG. 3. The number of conveyors in the improved advancing means 2 or 102 will be selected in dependency on the nature of the material of the carriers 38 and upon the dimensions and weight of the substrates. It is presently preferred to employ advancing means with pairs of conveyors to engage spaced-apart parallel edges (1*a*, 1*b* or 101*a*, 101*b*) of substrates which are to be transported through one or more coating stations. This results in a stable and reliable positioning and orientation of substrates during coating as well as during subsequent treatment and during removal from the advancing means. The utilization of two conveyors is advisable and advantageous if the substrates are to be transported in vertical planes during transport through the coating station or stations. This reduces the danger of undesirable shifting of substrates in the tunnel or housing 19 and/or 24 under the action of forces which are applied by atomized particles as they impinge upon the respective sides of the substrates as well as by the atomizing gas (normally air) which acts upon the substrates in the course of a coating operation. This renders it possible to employ coating means wherein the atomized particles are propelled against the respective sides of the substrates with a substantial force. The utilization of two conveyors further reduces the likelihood of improper coating of substrates in the second of two successive coating means if the circumstances prevailing in the housing of the first coating means are such that a single conveyor would be incapable of reliably retaining the substrates in a predetermined plane.

The apparatus of FIGS. 1–2 exhibits the advantage that the carriers 38 of the conveyors 3 and 4 need not be twisted during travel toward, through and beyond the coating station or stations. On the other hand, the apparatus of FIGS. 3–4 exhibits the advantage that it can employ simpler loading and unloading means because the orientation of substrates 101 is changed subsequent to loading of the substrates onto the advancing means 102. The main reason for maintaining the substrates in horizontal positions at the loading and unloading stations is because such positioning of the substrates is most convenient for proper stacking of substrates on pallets or other types of supports. On the other hand, many coating means are designed in such a way that they can operate best if the substrates are moved through the coating station or stations in vertical planes. This holds especially true if the apparatus is to coat both sides of each substrate. As far as the other treatments at the evaporating, drying, cooling and other stations are concerned, the devices at these stations may be designed for proper treatment of substrates while the substrates are held in horizontal or vertical or otherwise inclined positions.

While FIGS. 5–7 show a carrier whose innate elasticity suffices to ensure that the holding elements 40, 41 bear against each other with a requisite force (see FIG. 5) and that such holding elements properly engage and hold relatively narrow edges 1*a* of substrates (see FIG. 7), it is also within the purview of the invention to provide the carriers with built in or externally mounted springs (for example, leaf springs) which assist the holding elements 40, 41 in properly engaging the edges of substrates 1. Such springs can be installed in a manner which is similar to that shown for the flexible stiffening member 39 of FIG. 5. The stiffening member has been omitted in FIGS. 6 and 7 for the sake of simplicity. Furthermore, it is often sufficient if only selected portions of the carrier 38 are provided with flexible stiffening members.

The feature that the carriers 38 can adequately support the substrates 1 or 101 in an optimum orientation during travel through one or more (and even beyond) coating stations is desirable and advantageous because this ensures that no guides for the carriers are necessary in the housing 19 and/or 24. Such guides would be likely to be contaminated by the sprayed material so that they would require frequent maintenance and replacement. By properly selecting the dimensions, configuration and material of the carriers 38, the stability or stiffness of the carriers 38 will suffice to support the substrates during travel through the coating station or stations. The utilization of stiffening members 39 in the carriers 38 contributes to such stiffness and to the just discussed advantages of the respective conveyors.

FIG. 8 shows a portion of a modified apparatus wherein the advancing means 202 employs a single conveyor 203 in the form of an elongated foldable web of finite length. The web 203 is advanced along an elongated path by two takeup reels 66 and 67 which are also shown in FIG. 13. The means for supplying the web 203 into the path comprises a source 47 in the form of a reel having a core which is surrounded by a length of convoluted web material. The marginal portions 57, 58 (see particularly FIGS. 9, 10, 11 and 12) of the web 203 constitute two holding elements which are provided with adhesive coats 48, 49. The marginal portions or holding elements 57, 58 serve to perform the function of the holding elements 40, 41 of FIGS. 5–7 except that they actually adhere to the edges 201*a* of the substrates 201. The web 203 and the adhesive coats 48, 49 are made of a conductive material, and the web 203 is grounded at 51 and 52. These reference characters denote supports for an elongated folding member 50 which is preferably a straight horizontal or substantially horizontal bar having a circular or oval cross-sectional outline (see FIGS. 9–13). Additional connections to the ground can be provided for intermediate portions of the folding member 50. The web 203 can be made of paper, particularly crepe paper.

The reel 47 for the supply of web 203 is located upstream of a first profiled roll 53 which has a centrally located circumferentially extending groove 54 at a level above the adjacent portion of the folding member 50. The purpose of the roll 53 is to initiate a flexing or folding of the web 203 between its marginal portions or holding elements 57, 58, and such folding is thereupon continued by flexing rolls 55, 56 which are shown in FIG. 10. The folding is completed by rolls 59, 60 which are shown in FIG. 11 and which cause the adhesive coats 48, 49 of the respective holding elements or marginal portions 57, 58 to actually adhere to the respective sides of the edges 201*a* of substrates 201. The profiled portions 61 of the rolls 59, 60 shown in FIG. 1 cooperate with the folding member 50 to ensure proper encirclement of the major part of the folding member by the intermediate portion of the web 203. Furthermore, the profiled portions 61 of the rolls 59, 60 support the adjacent portion of the folding member 50 so that the latter is maintained at a desired level. The substrates 201 can enter the first of several coating stations or a single coating station downstream of the rolls 59, 60 namely as soon as the adhesive coats 48, 49 ensure proper retention of the substrates 201 by the respective marginal portions 57, 58 of the folded web 203. If necessary, the apparatus of FIG. 8 can further comprise at least one pair of rolls 62, 63 (see FIG. 12) which have grooves 64 to support the folding member 50 against sagging in the corresponding portion or portions of the path for the web 203 and substrates 201. The coating station or stations are followed by a severing device 65 which severs the web midway between its marginal portions 57, 58 so that the thus separated marginal portions can be gathered by the two takeup reels 66, 67 which are shown in FIG. 13 and which can further constitute a means for advancing the web 203 along the folding member 50. The means for driving the reels 66, 67 include shafts one of which is shown in FIG. 8. The gathered marginal portions or holding elements 57, 58 can be discarded.

The folding member 50 is confined within the folded web 203 all the way between the rolls 59, 60 and reels 66, 67 so that it cannot be contaminated by the atomized material which is applied to the surfaces of the substrates 201.

The apparatus of FIGS. 8–13, as well as the apparatus of FIGS. 1–2 or 3–4, can be operated continuously or in stepwise fashion. Furthermore, it is possible to automate each of these apparatus to any desired extent, including complete automation.

An advantage of the apparatus of FIGS. 8–13 is that eventual contamination of the web 203 is of no consequence because the gathered marginal portions or holding elements 57, 58 are discarded after a single use. In addition to webs 203 of paper, the apparatus of FIGS. 8–13 can also employ webs of a suitable plastic material which is sufficiently inexpensive to warrant discarding of holding elements 57, 58 after a single use. The nature of adhesive coats 48, 49 is preferably selected in such a way that they can be readily peeled off the respective sides of the edges 201*a* of substrates 201. The forces with which the rolls 59, 60 of FIG. 11 cause the marginal portions 57, 58 to bear against the edges 201*a* of the substrates 201 are relatively small since the adhesive coats 48, 49 ensure proper retention of substrates 201 in optimum positions for transport through one or more coating stations.

It has been found that a small-diameter folding member 50 suffices to define a satisfactory straight path for the conveyor which is constituted by the web 203. In other words, propping of the folding member 50 intermediate its ends (at 51 and 52) is optional.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for electrostatically spray coating edge-supported substrates, such as circuit boards, comprising means for advancing substrates including at least one pair of holding elements arranged to engage at least substantial parts of the edges of a series of successive substrates, at least one of said holding elements constituting an endless strip, an endless elastic carrier integral with said holding elements, said elements bearing against each other in the absence of edges of substrates between them, and means for moving the holding elements in a predetermined direction along a predetermined path, said elements containing a current-conducting material; means for spreading said elements apart preparatory to introduction of edges of substrates between said elements; coating means adjacent at least one portion of said path and including means for directing at least one spray of coating material against successive substrates of said series; and means for grounding at least one of said said elements, at least during travel along said at least one portion of said path.

2. The apparatus of claim 1 for coating substrates of the type having pairs of substantially parallel spaced-apart edges, wherein said advancing means includes a pair of holding elements for each edge of successive substrates of said series.

3. The apparatus of claim 2, wherein said advancing means further comprises means for changing the orientation of said pairs of holding elements and of the substrates between said pairs of holding elements in at least one portion of said path.

4. The apparatus of claim 3, wherein said orientation changing means comprises means for moving successive substrates of said series between a first plane in which the substrates are substantially horizontal and a second plane in which the substrates are substantially vertical.

5. The apparatus of claim 4, wherein said orientation changing means is located ahead of said coating means and the substrates of said series are located in said second plane during exposure to the at least one spray of coating material.

6. The apparatus of claim 1, wherein said spreading means comprises a pair of spreading members defining a clearance for the passage of said carrier therebetween.

7. The apparatus of claim 6, wherein said carrier has at least one longitudinally extending cavity and successive increments of said cavity pass between said spreading members when said holding elements are in motion, the width of said clearance being such that successive increments of said carrier are deformed in the region of said cavity during movement through said clearance with resulting spreading apart of said holding elements.

8. The apparatus of claim 1, wherein said advancing means further comprises pulleys for said carrier, said carrier being trained over said pulleys and including at least one profiled portion engaging said pulleys.

9. The apparatus of claim 1, wherein said carrier has a rigidity and/or a cross-sectional outline such as to enable said holding elements to maintain the substrates in a predetemrined orientation during travel along said at least one portion of said path.

10. The apparatus of claim 9, wherein said carrier is located at a first level and said holding elements are disposed at a different second level, at least during movement align said at least one portion of said path.

11. The apparatus of claim 1, wherein said carrier includes an elastic body and at least one stiffening member confined in said elastic body.

12. Apparatus for electrostatically spray coating edge-supported substrates, such as circuit boards, comprising means for advancing substrates including at least one pair of holding elements arranged to engage at least substantial parts of the edges of a series of successive substrates, at least one of said elements constituting a continuous strip of finite length, and means for moving the holding elements in a predetermined direction along a predetermined path, said elements containing a current-conducting material and said advancing means further comprising an elongated foldable web having two marginal portions constituting said holding elements, and means for folding said web substantially midway between said marginal portions so as to move the marginal portions toward each other and into contact with the edges of substrates between such marginal portions; coating means adjacent at least one portion of said path and including means for directing at least one spray of coating material against successive substrates of said series; means for grounding at least one of said elements, at least during travel along said at least one portion of said path; means for supplying said elements into a second portion of said path ahead of said at least one portion; and means for gathering said elements in a third portion of said path downstream of said at least one portion.

13. The apparatus of claim 12 for coating substrates of the type having pairs of substantially parallel spaced-apart edges, wherein said advancing means includes a pair of holding elements for each edge of successive substrates of said series.

14. The apparatus of claim 13, wherein said advancing means further comprises means for changing the orientation of said pairs of holding elements and of the substrates between said pairs of holding elements in at least one portion of said path.

15. The apparatus of claim !4, wherein said orientation changing means comprises means for moving successive substrates of said series between a first plane in which the substrates are substantially horizontal and a second plane in which the substrates are substantially vertical.

16. Tho apparatus of claim 15, wherein said orientation changing means is located ahead of said coating means and the substrates of said series are located in said second plane during exposure to the at least one spray of coating material.

17. The apparatus of claim 12, wherein said marginal portions are provided with coats of adhesive material so as to adhere to the edges of substrates.

18. The apparatus of claim 17, wherein said folding means is located ahead of said at least one portion of said path and includes an elongated folding member and means for flexing the web around said folding member so that said marginal portions are disposed at opposite sides of said folding members.

19. The apparatus of claim 18, further comprising means for severing the web between said marginal portions downstream of said at least one portion of said path.

20. The apparatus of claim 19, further comprising means for separating the marginal portions of the web from the edges of substrates downstream of said severing means.

21. The apparatus of claim 20, wherein said separating means comprises takeup reels for the separated marginal portions of the web.

22. The apparatus of claim 18, wherein said folding member comprises a bar extending along said path.

23. The apparatus of claim 22, wherein said bar has a substantially circular or oval cross-sectional outline.

24. The apparatus of claim 18, wherein said advancing means further comprises a source of web and means for drawing the web from said source and along said path.

25. The apparatus of claim 24, wherein said source includes a reel and the web is convoluted on said reel.

26. The apparatus of claim 18, wherein said flexing means includes at least one pair of rolls.

27. The apparatus of claim 18, further comprising means for supporting said folding member, said supporting means including at least one pair of rolls.

28. Apparatus for electrostatically spray coating edge-supported substrates, such as circuit boards, comprising means for advancing substrates including at least one pair of substantially strip shaped holding elements arranged to engage at least substantial parts of the edges of a series of successive substrates, said elements containing a current-conducting material, means for moving the holding elements in a predetermined direction along a predetermined path, an elongated foldable web having two marginal portions constituting said holding elements, and means for folding said web substantially midway between said marginal portions so as to move the marginal portions toward each other and into contact with the edges of substrates between such marginal portions, said marginal portions being provided with coats of adhesive material so as to adhere to the edges of substrates; and coating means adjacent at least one portion of said path and including means for directing at least one spray of coating material against successive substrates of said series, said folding means being located ahead of said at least one portion of said path and including an elongated folding member and means for flexing the web around said folding member so that said marginal portions are disposed at opposite sides of said folding member.

29. The apparatus of claim 28, further comprising means for severing the web between said marginal portions downstream of said at least one portion of said path.

30. The apparatus of claim 29, further comprising means for separating the marginal portions of the web from the edges of substrates downstream of said severing means.

31. The apparatus of claim 30, wherein said separating means comprises takeup reels of the separated marginal portions of the web.

32. The apparatus of claim 31, wherein said folding member comprises a bar extending along said path.

33. The apparatus of claim 32, wherein said bar has a substantially circular or oval cross-sectional outline.

34. The apparatus of claim 33, wherein said advancing means further comprises a source of web and means for drawing the web from said source and along said path.

35. The apparatus of claim 34, wherein said source includes a reel and the web is convoluted on said reel.

36. The apparatus of claim 28, wherein said flexing means includes at least one pair of rolls.

37. The apparatus of claim 28, further comprising means for supporting said folding member, said supporting means including at least one pair of rolls.

* * * * *